US009748014B2

(12) United States Patent
Pillet

(10) Patent No.: US 9,748,014 B2
(45) Date of Patent: Aug. 29, 2017

(54) POWDER AND PASTE FOR IMPROVING THE CONDUCTIVITY OF ELECTRICAL CONNECTIONS

(71) Applicant: AMC HOLDING, Cannes (FR)

(72) Inventor: Michel Pillet, Cannes (FR)

(73) Assignee: AMC, Saint-Raphael (FR)

( * ) Notice: Subject to any disclaimer, the term of this patent is extended or adjusted under 35 U.S.C. 154(b) by 123 days.

(21) Appl. No.: 14/433,568

(22) PCT Filed: Oct. 2, 2013

(86) PCT No.: PCT/FR2013/000258

§ 371 (c)(1),
(2) Date: Apr. 3, 2015

(87) PCT Pub. No.: WO2014/053715

PCT Pub. Date: Apr. 10, 2014

(65) Prior Publication Data

US 2015/0262723 A1 Sep. 17, 2015

(30) Foreign Application Priority Data

Oct. 3, 2012 (FR) ..... 12 02631

(51) Int. Cl.

| | |
|---|---|
| ***H01B 1/02*** | (2006.01) |
| ***B22F 9/04*** | (2006.01) |
| ***H01B 13/00*** | (2006.01) |
| ***H01B 1/16*** | (2006.01) |
| ***H01R 13/03*** | (2006.01) |
| *H01R 4/30* | (2006.01) |
| *H01R 4/20* | (2006.01) |

(52) U.S. Cl.

CPC ..... *H01B 1/02* (2013.01); *B22F 9/04* (2013.01); *H01B 1/16* (2013.01); *H01B 13/00* (2013.01); *H01R 13/03* (2013.01); *B22F 2009/046* (2013.01); *H01R 4/20* (2013.01); *H01R 4/304* (2013.01); *Y10T 428/12181* (2015.01)

(58) Field of Classification Search

None

See application file for complete search history.

(56) References Cited

U.S. PATENT DOCUMENTS

| | | | | |
|---|---|---|---|---|
| 3,539,973 | A | 11/1970 | Antes et al. | 339/143 |
| 3,649,954 | A | 3/1972 | Kurtz | 339/95 R |
| 4,023,882 | A | 5/1977 | Pettersson | 439/426 |
| 4,923,739 | A | 5/1990 | Jin et al. | 428/221 |
| 5,153,818 | A | 10/1992 | Mukougawa et al. | 361/395 |
| 5,360,355 | A | 11/1994 | Ehrler et al. | 439/816 |
| 5,620,290 | A | 4/1997 | Homfeldt | 411/533 |
| 5,857,858 | A | 1/1999 | Gorowitz et al. | 439/86 |
| 5,865,638 | A | 2/1999 | Trafton | 439/288 |
| 6,114,645 | A | 9/2000 | Burgess | 200/512 |
| 6,309,742 | B1 | 10/2001 | Clupper et al. | 428/304.4 |
| 7,044,755 | B2 | 5/2006 | Hatakeyama | 439/97 |
| 7,229,296 | B2 | 6/2007 | Pillet | 439/86 |
| 9,093,778 | B2 * | 7/2015 | Pillet | H01R 4/304 |
| 2004/0074338 | A1 | 4/2004 | Kuhn et al. | 75/415 |
| 2005/0042895 | A1 | 2/2005 | Liu | 439/66 |
| 2006/0204741 | A1 | 9/2006 | Rehbein et al. | 428/304.4 |
| 2006/0270277 | A1 | 11/2006 | Zhao et al. | 439/627 |
| 2013/0122730 | A1 | 5/2013 | Pillet | 439/271 |
| 2013/0244034 | A1 * | 9/2013 | Ishikawa | B22F 9/06 428/402 |
| 2014/0057482 | A1 | 2/2014 | Su et al. | 439/493 |
| 2014/0111956 | A1 * | 4/2014 | Taniguchi | B23K 35/02 361/771 |

FOREIGN PATENT DOCUMENTS

| | | | |
|---|---|---|---|
| DE | 102008017157 | | 10/2009 |
| EP | 2 148 393 | | 1/2010 |
| JP | 53-80589 | | 7/1978 |
| JP | 2004298962 | A * | 10/2004 |
| JP | 2008200728 | A * | 9/2008 |
| JP | 2008311273 | A * | 12/2008 |

* cited by examiner

*Primary Examiner* — Tanisha Diggs

(74) *Attorney, Agent, or Firm* — James C. Lydon

(57) ABSTRACT

An electrical connection powder comprising particles obtained by pulverizing a skeleton of open cell metal foam chosen from the group consisting of iron, cobalt, nickel and the alloys of same covered with at least one coating of tin or indium or one of the alloys of same. The paste is formed from this powder dispersed in a binder such as grease. The powder or paste is particularity useful for improving the conductivity of an electrical connection consisting of a terminal (20) linked to a cable (24) consisting of a plurality of strands (30, 32, 34) by means of a crimping ring (26).

8 Claims, 2 Drawing Sheets

POWDER AND PASTE FOR IMPROVING THE CONDUCTIVITY OF ELECTRICAL CONNECTIONS

TECHNICAL FIELD

The present invention relates to techniques for improving the electrical connection between two metallic conductors, and more particularly relates to a powder and a paste for improving the conductance of the electrical connection between two metallic conductors.

STATE OF THE ART

In all the fields where metal electrical connections are used, and more particularly in the field of power electronics, the electrical connections wherein two metals are in contact deteriorate over time. This results in significant electrical losses due to the increasingly high electrical resistance between the conductors. This causes variations in the current density across the surfaces of the conductors. This entails neat losses and, consequently, results in an increase in temperature. The deterioration of the contacting surfaces accelerates the deterioration of the connections but also of the conductors and may even result in the melting thereof. As such deterioration is irreversible, a yield loss occurs which affects the performances of the devices comprising such electrical connections.

The electrical connection is also damaged when a terminal is used at the end of a cable consisting of conductive strands. Such deterioration results from the damaged electrical contact between the terminal and the exterior strands of the cable, and between the strands themselves, which then causes a high resistance. As mentioned above, a significant heating of the electrical connection and, sometimes, the melting of cable strands then occurs.

With a view to improving the electrical correction between two metal conductors, the French Patent published under N° 2,847,391 discloses a contact device comprising a conductive element made of silver foam inserted between the two contact surfaces of two conductors of an electrical connection. Unfortunately, silver foam is particularly expensive.

Another French patent published under N° 2,962,856 also discloses a contact device comprising an inserted, conductive element consisting of a skeleton of metal foam chosen from the group consisting of iron, cobalt, nickel and the alloys of same covered with at least one coating of tin, indium or one of the alloys of same.

As illustrated in FIG. 1 of this patent, the two conductors 12 and 14 are separated, by a conductive inserted element 10 made of metal foam so that the surfaces thereof come into contact with the foam. The electrical connection between the conductors 12 and 14 is provided by intimate contact using a clamping means such as a clamping bolt 16 going through the two conductors and the conductive inserted element.

As illustrated in FIG. 2 of the same patent, the inserted member preferably includes a peripheral seal 20 making it possible to reduce the penetration of damaging external agents by creating a tight barrier on the contact periphery.

It should be noted that, mainly for economical reasons, conductors made of aluminum, a metal which has an electrical conductivity very close to that of copper while being much cheaper, are currently substituted for copper conductors in all the connections. But a drawback of aluminum is that a layer of alumina is formed, which makes the connectivity difficult between the connections by increasing the resistance between the conductors.

DISCLOSURE OF THE INVENTION

The main object of the present invention is thus to provide electrical connection means making it possible to improve the electrical conductance of an electrical connection and to slow down the deterioration of the contacting surfaces, especially when the connection is provided using a cable comprising a plurality of strands.

A first object of the Invention is an electrical connection powder consisting of particles of cellular open cell metal foam chosen from the group consisting of iron, cobalt, nickel and the alloys of same covered with at least one coating of tin, indium or one of the alloys of same.

A second object of the invention is an electrical connection paste comprising the above powder and a binder wherein the powder is dispersed.

BRIEF DESCRIPTION OF THE FIGURES

Other aims, objects and characteristics of the invention will appear more clearly upon reading the following description, while referring to the appended drawings wherein.

DETAILED DESCRIPTION OF THE INVENTION

Figure 1:
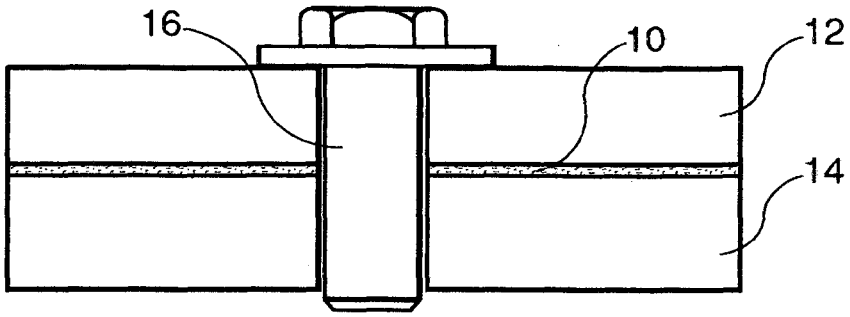
FIG. 1 shows a section of one embodiment of an electrical connection described in the French Patent published under N° 2,962,856.
Figure 2:
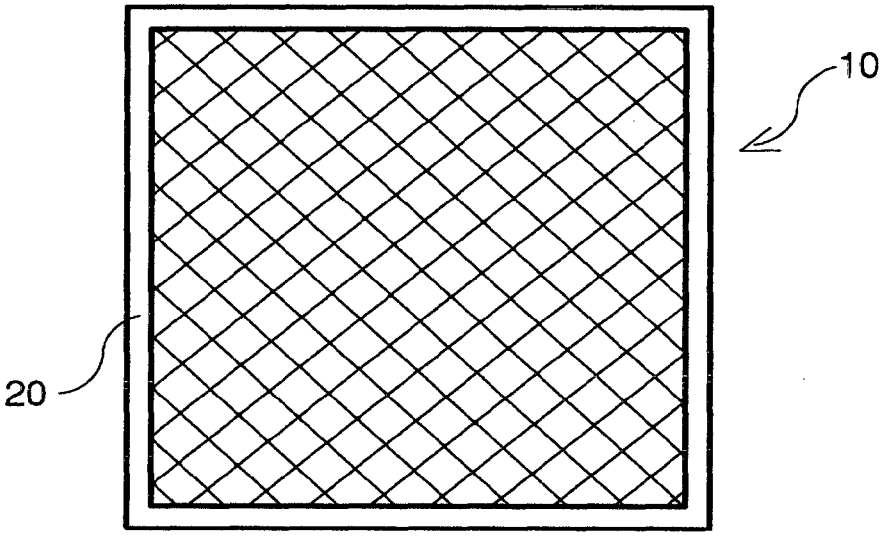
FIG. 2 shows a conductive inserted element described in the French Patent published under N° 2,962,856.

An electrical connection according to the principles of the invention can be provided as the one shown in FIG. 1. Like in the French patent published under N° 2,962,856, the connection may include a conductive element 10 inserted between two conductors 12 and 14, but this inserted element is made of the powder or the paste which are the objects of the invention.

The electrical connection between the conductors 12 and 14 is provided by intimate contact using a clamping means such as a clamping bolt 16 going through the two conductors and the conductive inserted layer 10.

It should be noted that, upon tightening the two conductors together, the inserted member is compressed and the thickness thereof decreases partly because particles of powder or the binder of the paste wherein the powder is dispersed are ejected at the periphery of the inserted element. Therefore, no seal is required around the inserted element unlike the embodiment described in the patent published under N° 2,962,356.

At least one of the conductors is preferably made of aluminum. However, the present invention is not limited to this case and is applicable to all the conductors, for example those made of copper.

The metal foam is an open cell foam of the cellular type consisting of a skeleton of metal foam chosen from the group consisting of iron, cobalt, nickel and the alloys of same covered, for example directly, with at least one metal coating such as a coating of tin, indium or one of the alloys of same.

The foam skeleton can be obtained using several methods that have been described in the French Patent published under N° 2,962,856.

The foam has a cellular structure and its physical property is primarily high porosity and deformability, which results in the reduction, of the electrical resistance of the connection, and a low density of about 400 g/m.

One characteristic of the invention lies in that the skeleton of metal foam is covered, for example directly, with a coating of another metal, by electrolysis or any other method (spraying, immersion into a bath . . . ) so that the entire cellular surface is covered with such other metal. Unlike the metal constituting the skeleton, the coating metal is preferably a ductile metal such as tin, indium or one of the alloys of same, so as to increase the contact surface of each point of the metal constituting the skeleton, to penetrate into the streaks at the conductor surface and to improve the electrochemical compatibility between the foam skeleton and the metal the conductor is made of.

It should be noted that the first coating may also be covered with another coating of a different metal from, the first coating, and so on. For example, if the first coating is tin, the second coating may be indium. The metal foam is then pulverized by any suitable means.

It should be noted that the grains thus obtained preferably have a diameter ranging from about 0.5 mm to 5 mm, and preferably from one to two millimeters, for example 1.6 mm.

The metal foam, is then pulverized and the particles of the powder obtained have a size ranging from 1 to 2 mm, using any appropriate means making it possible to preserve the cellular structure. It should be noted that the powder can be obtained by cutting the foam, preferably using a laser, which does not affect the cellular structure of the foam and makes it possible to preserve ail the electrical and mechanical characteristics of the foam. In addition, the laser cutting also makes it possible to create sharp edges on the small fragments of foam, which will thus more easily penetrate into the contacting conductors.

The powder obtained mainly consists of voids, because of its cellular structure. The surface of the powder particles thus comprises a plurality of contact points of the order of one micron, the number of which can reach 30 points per $mm^2$. Thanks to these points, the inserted element 10, which has many contacts, provides a high conductivity and thus a low resistance.

According to a second, aspect of the invention, the powder is dispersed into a binder so as to form a paste which, like the powder, makes it possible to improve the electrical conductance of an electrical connection. Such binder, which may be grease or petroleum jelly, completely fills the cells of the foam particles, which prevents the penetration of pollutants or agents which might oxidize or deteriorate the surfaces.

In addition, such grease may incorporate anti-oxidation products and metal particles of a few microns which increase its service life. The particles may be particles of silver, gold or any other metal which is a fair conductor of electricity. According to an alternative solution, the foam powder may also be impregnated or loaded with a component intended to prevent the forming of a highly resistive layer on the surface of the conductors, such as alumina on a conductor made of aluminum, and/or to pickle the surface of the conductors.

The powder and the paste which are the objects of the invention can be used for an old electrical connection or a new electrical connection.

In a new electrical connection, the contact is especially important since it is located close to the clamping means or clamping bolt 16. Therefore, the resistance, and thus the electrical losses of the electrical connection consisting of the contacting conductors 12 and 14, is at a minimum near the clamping means 16 and increases when and as the distance therewith increases. Such inhomogeneous current distribution enhances a zone with a higher current concentration and thus a more stressed and therefore more rapidly damaged zone. The addition of conductive particles of powder or paste of the layer 10 increases the contact points between the two conductors 12 and 14 and thus allows a uniform distribution of current across the whole contact surface. Thanks to such a homogeneous distribution, no current concentration zone therefore no stressed zone exposed to a more rapid degradation is created.

The powder and the paste which are the objects of the invention may also be advantageously used for a contact of a degraded or distorted electrical connection. Such degradation is due to the oxygen in the air which causes the forming of an oxide layer. Thus, in the case of aluminum conductors, such oxide, which is alumina, increases the resistance of the connection.

In the inserted element 10, the points on the surface of the powder particles also go through the oxide layer such as alumina which continuously forms on the surface of the conductors 12 and 14, which makes it possible to improve the electrical conductance of a used connection, even without cleaning it beforehand.

The advantage of using the paste described above is essential, when the electrical connection is provided by a cable. As a matter of fact, as an electrical cable consists of a plurality of conductive strands, its end linked to a terminal has a resistance which becomes higher and higher over time because the strands are not sufficiently electrically interconnected. Such resistance results, on the one hand, from the deteriorated contact of the external strands of the cable with the crimping ring which connects the cable to the terminal, and on the other hand from the deteriorated contact between the external strands and the internal strands of the cable.

It should be noted that another advantage of the paste according to the invention consists in providing a coating of the strands which prevents the oxidation of same.

Figure 3:
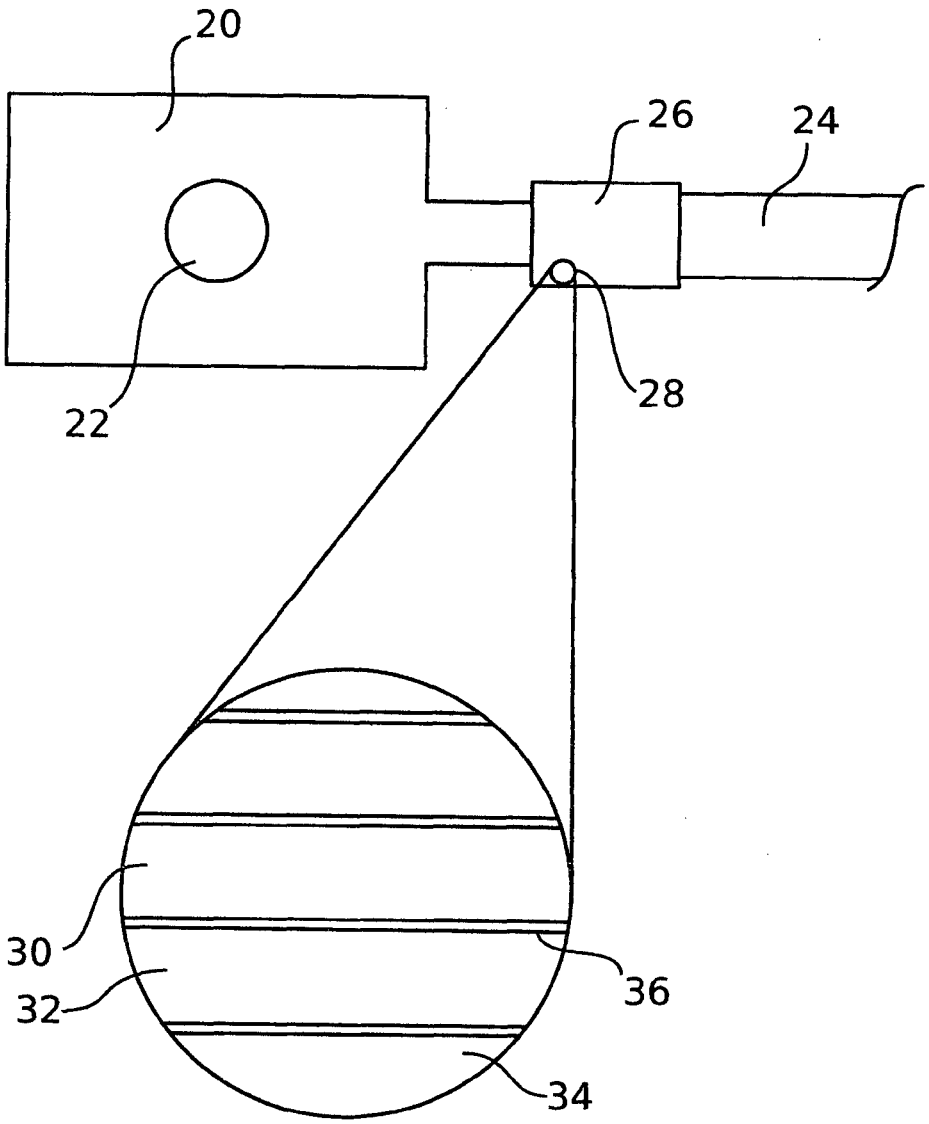
FIG. 3 shows the end of an electrical connection; cable with an exploded view of a portion of the crimping ring.

FIG. 3 shows an electrical connection using a cable. The end is composed of a terminal 20 which is generally flat and is provided with a hole 22 used for tightening the terminal onto another flat conductor. The contact between the terminal and the other conductor is improved as described above using an intermediate layer of powder or paste, the objects of the invention.

The terminal 20 is linked to the cable 24 by a crimping ring 26 whereon strong pressure is exerted upon assembling, in order to obtain a good electrical contact between the terminal 20 and the cable 24.

Prior to crisping the cable 24 with the ring 26, the cable is soaked into the powder, i.e. the object of lure present invention, or the cable strands are covered with the paste, i.e. the object of the present invention, for example by spraying, so that the paste fills the gaps between the strands of the cable, for example the gap 36. When the cable 24 is crimped with the ring 26, the powder or the paste goes deeper into the gaps thanks to the pressure exerted thereon.

The powder and the paste, i.e. the objects of the present invention, are particularly all the more advantageous since their efficiency increases with temperature. As a matter of fact, the voltage drop of a 1 $dm^2$ connection using the powder or the paste according to the invention from nickel foam covered with tin is of the order of a few mVs for a current having an intensity of 5000 A and at a temperature of 80° C. Such distinctive characteristic is due to the fact that the points of the foam fuse with the conductors which they are in contact with under the effect of temperature.

As mentioned above, the powder and the paste according to the invention are particularly advantageous for improving the conductance of the electrical connections wherein both conductors are made of aluminum, but also when one of the conductors is made of copper and the other one is made of aluminum or when both conductors are made of copper.

Eventually, thanks to the reduction in the electrical losses they induce, the powder and the paste, i.e. the objects of the present invention, are particularly suitable for heavy currents, for instance having an intensity above 1000 A.

It should be noted that using elastically deferrable foam particles also has the advantage of reducing the impact of a release of the clamping means, since in this case the foam particles relax and still conform to the contact surfaces at the cost of a lower pressure onto such contact surfaces.

The powder and the paste, i.e. the objects of the present invention can be applied to all the fields of electrical engineering that appeal to heavy currents. Theism in the field of electrolytic cells and steel furnaces, the wear of the electrical connections, which are exposed to heavy currents and high temperatures, mainly materializes by a deformation of the contact surfaces of the electrical connections. This results in substantial electrical losses which may reach several KWs per connection and in variations in the intensity of the current going through such contact surfaces.

It should be noted that the powder or the paste, the objects of the present invention, may also be used to improve the sliding contacts in heavy industries such as the anode contacts used in the electrolysis of aluminum.

Thanks to the invention which has just been disclosed, a significant improvement of the electrical connections having deteriorated and distorted contact surfaces is obtained, even in the case of deformation of the order of one millimeter. As a matter of fact, the powder or the paste, the objects of the present invention, conform to the profiles of the deteriorated contacting surfaces of the conductors and thus increase the contact surface.

The invention claimed is:

1. An electrical connection powder material comprising particles of cellular foam with open cells and having a diameter between 1 and 2 mm, with said foam comprising a foam metal skeleton selected from the group consisting of iron, cobalt, nickel and alloys thereof coated with at least one coating of tin, indium or an alloy thereof, and a binder comprising anti-oxidation products and metal particles.

2. A powder material according to claim 1, wherein said foam metal skeleton comprises a nickel foam skeleton.

3. A powder material according to claim 2, wherein said nickel foam skeleton is covered with a coating of tin.

4. A powder material according to claim 1, wherein said binder contains fat.

5. A powder material according to claim 1, wherein said metal particles are selected from the group consisting of particles of silver, gold or another metal which is a conductor of electricity.

6. A powder material according to claim 1, wherein a diameter of said open cells is from 1.6 to 2.0 mm.

7. A method for producing a powder material according to claim 1, comprising the steps of developing a foam metal skeleton with open cells and then of cutting same into particles having a size ranging from 1 to 2 mm using a means which preserves the open cells of the foam.

8. A method according to claim 7, wherein said means for cutting the foam is a laser device.

* * * * *